US009451680B2

(12) United States Patent
van der Brug

(10) Patent No.: US 9,451,680 B2
(45) Date of Patent: Sep. 20, 2016

(54) METHOD OF CONTROLLING A LIGHTING SYSTEM AND A LIGHTING SYSTEM

(71) Applicant: KONINKLIJKE PHILIPS N.V., Eindhoven (NL)

(72) Inventor: Willem Peter van der Brug, Best (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/762,523

(22) PCT Filed: Jan. 10, 2014

(86) PCT No.: PCT/IB2014/058168
§ 371 (c)(1),
(2) Date: Jul. 22, 2015

(87) PCT Pub. No.: WO2014/118658
PCT Pub. Date: Aug. 7, 2014

(65) Prior Publication Data

US 2015/0327350 A1 Nov. 12, 2015

Related U.S. Application Data

(60) Provisional application No. 61/757,779, filed on Jan. 29, 2013.

(51) Int. Cl.
*H05B 37/02* (2006.01)
*H05B 37/03* (2006.01)

(52) U.S. Cl.
CPC ..... *H05B 37/0281* (2013.01); *H05B 37/03* (2013.01); *H05B 37/032* (2013.01)

(58) Field of Classification Search
CPC ..... H05B 33/0815; H05B 33/0818; H05B 33/0809; H05B 37/029; H05B 37/02; H05B 41/3925; H05B 41/391; H05B 41/2828; H05B 33/0803
USPC ..... 315/149, 307, 294, 224
See application file for complete search history.

(56) References Cited

U.S. PATENT DOCUMENTS 5,703,439 A * 12/1997 Nerone ..... H05B 41/2827 315/209 R
5,717,295 A * 2/1998 Nerone ..... H05B 41/2828 315/209 R (Continued)

FOREIGN PATENT DOCUMENTS

| | | | |
|---|---|---|---|
| EP | 0794691 | A2 | 3/1997 |
| KR | 20080081390 | A | 9/2008 |
| WO | 2010004461 | A2 | 1/2010 |

*Primary Examiner* — Douglas W Owens
*Assistant Examiner* — Syed M Kaiser
(74) *Attorney, Agent, or Firm* — Meenakshy Chakravorty

(57) ABSTRACT

A lighting system and a corresponding method are provided. The method comprises: sending a change operational state command to a lighting device group (3) comprising several lighting devices (9); at each lighting device, applying a randomized delay within a predetermined delay interval or an individual predetermined delay within the delay interval; changing the operational state in accordance with the change operational state command at each lighting device at the end of each respective delay; detecting changes in the total drive power fed to the group of lighting devices within the delay interval and counting the total number of changes; comparing the total number of changes with a nominal number corresponding with the number of lighting devices within the group of lighting devices; generating a lighting device error signal if the number of changes is smaller than a predetermined fraction of the nominal number, including the nominal number.

14 Claims, 5 Drawing Sheets

(56) References Cited

U.S. PATENT DOCUMENTS 5,987,539 A * 11/1999 Goodrum ..... G06F 13/4045 710/310
6,018,200 A * 1/2000 Anderson ..... B23K 9/1062 290/1 A
6,028,396 A 2/2000 Morrissey, Jr. et al.
6,542,082 B1 4/2003 Nowka et al.
2002/0180367 A1* 12/2002 Logan ..... H05B 37/0209 315/119
2011/0140612 A1* 6/2011 Mohan ..... H05B 37/0218 315/149
2011/0187271 A1 8/2011 Bouws et al.
2011/0216453 A1* 9/2011 Haines ..... H02H 9/00 361/49
2013/0099692 A1* 4/2013 Chaji ..... H05B 37/02 315/224

* cited by examiner

1- Lighting System; 3, 5- Lighting Device Groups; 7- Control Device;
9- Lighting Device; 11- Light Source; 13- Drive unit;
15- Light Source Controller; 17- Delay Unit; 19- Drive Voltage Generator.

METHOD OF CONTROLLING A LIGHTING SYSTEM AND A LIGHTING SYSTEM

CROSS-REFERENCE TO PRIOR APPLICATIONS

This application is the U.S. National Phase application under 35 U.S.C. §371 of International Application No. PCT/IB2014/058168, filed on Jan. 10, 2014, which claims the benefit of U.S. Provisional Patent Application No. 61/757,779, filed on Jan. 29, 2013. These applications are hereby incorporated by reference herein.

FIELD OF THE INVENTION

The present invention relates to lighting telemanagement systems and other systems that monitor the status and condition of groups of lights.

TECHNICAL BACKGROUND

A test apparatus for testing the operation of a lighting system is disclosed in U.S. Pat. No. 6,542,082, which discloses determination of whether a lighting device in a group of lighting devices contained in a remotely located unit under test works properly or not. The determination is done by selecting one lighting device at a time and testing that lighting device. Thus, the test apparatus transmits control signals to the unit under test for selecting a lighting device and for changing the operational state of the selected lighting device, and determines a change in the current that is drawn by the unit under test. For example, if the test apparatus determines that there is no change of current or if the change is less than expected, then it decides that the lighting device is defective.

Such an individualized testing is possible in lighting systems where an individual lighting device can be identified. However, such lighting systems are undesirably expensive for many applications. Therefore, it would be desired to be able to remotely detect defective lighting devices also in less expensive lighting systems where it is not possible to select and identify an individual lighting device.

SUMMARY OF THE INVENTION

It is an object of the present invention to provide a method of controlling a lighting system, a lighting system, and a lighting device that alleviate the above-mentioned problems of the prior art.

The object is achieved by a method of controlling a lighting system, a lighting device, and a lighting system, respectively, according to the present invention as defined in the claims.

Thus, in accordance with an aspect of the present invention, there is provided a method of controlling a lighting system comprising:

sending a change operational state command to a lighting device group comprising several lighting devices, and thereby prompting the lighting devices to change their operational state with a randomized delay within a delay interval;

detecting changes in the total drive power fed to the group of lighting devices within the delay interval and counting the total number of changes;

comparing the total number of changes with a nominal number corresponding with the number of lighting devices within the group of lighting devices;

generating a lighting device error signal if the number of changes is smaller than the nominal number multiplied by a predetermined constant c, wherein $0<c\leq 1$.

Consequently, by means of the present method it is possible to detect that a lighting device is defective in conjunction with a change of the operational state, such as turning the lighting devices on or off or dimming them. In spite of a simple communication structure, where the command is simply sent to all lighting devices in the group without having to generate any response or perform any procedure of identifying individual lighting devices, the method is able to detect defective lighting devices. Since the number of lighting devices of a group is limited, the burden for an operator to check which lighting device(s) in the group is defective is small in comparison with the gain of automatically detecting that a lighting device has become defective. Since the lighting device error signal is generated if the number of changes is smaller than the nominal number multiplied by a predetermined constant c, wherein $0<c\leq 1$, the method is adaptable to different levels of acceptance as regards the percentage of defective lighting devices. Thus, in some applications even a single defective lighting device is not acceptable, while in other applications it is sufficient to generate an error signal once a certain number of lighting devices are defective. In such applications, values of $c<1$ will be suitable.

For the purposes of this application, and as easily recognizable by a person skilled in the art, the term "drive power" means the very power consumption or any amount which can be associated with the power consumption, such as the drive current, or a drive voltage caused by the drive current, or the like.

According to an embodiment of the method, said detecting changes in the total drive power comprises obtaining knowledge about a single change, which corresponds to the amount of change caused by a single lighting device, and determining, in conjunction with the sending of a first change operational state command, the nominal number by means of at least one of the total number of changes and the total amount of change caused by the total number of changes.

Consequently, it is not necessary, although possible, to input a value of the total number of lighting devices of the group, but this total number is determined the first time a change of the operational state is performed. This means that according to the method it is presumed that all lighting devices work properly from the beginning, which is a reasonable presumption.

According to an embodiment of the method, said obtaining knowledge about a single change comprises determining a median amount of change of all changes, and setting that median amount as the single change.

According to an embodiment of the method, said detecting changes in the total drive power comprises determining the number of lighting devices that each detected change corresponds to by comparing the amount of the change with the single change. Since each lighting device independently applies a random delay within a delay interval it might occur that two or more lighting devices apply the same delay. That will be detected according to this embodiment, and thereby erroneous indications about defective lighting devices are prevented.

According to an embodiment of the method, the change operational state command comprises a value of the delay interval. Thus, it is possible to change the delay interval from remote if desired.

According to an embodiment of the method, it further comprises at each lighting device, applying the randomized delay within the delay interval; and changing the operational state in accordance with the change operational state command at each lighting device at the end of each respective delay.

According to an embodiment of the method, said applying the randomized delay comprises randomly determining a new delay every time a change operational state command including a delay trigger is received. This provides for a high flexibility.

According to an embodiment of the method, said applying the randomized delay comprises determining a fixed random delay at a first power up of the lighting device. This provides technical simplicity.

In accordance with another aspect of the present invention there is provided a lighting device comprising at least one light source, and a drive unit connected with said at least one light source, wherein the drive unit is arranged to apply a randomized delay within a predetermined delay interval, upon the receipt of a change operational state command, and to change the operational state of the lighting device at the end of the delay. Since the drive unit is capable of randomly delaying the change of operational state, it is possible to detect that change over one and the same power line for several lighting devices, although they are not actively sending any information to a controlling device.

According to an embodiment of the lighting device the drive unit comprises a light source controller, a delay unit connected with the light source controller, and a drive voltage generator connected with the light source controller.

In accordance with the present invention there is also provided a lighting system comprising at least one lighting device group, which comprises several lighting devices of the kind just described, and a control device connected with the group. The control device is arranged to send a change operational state command to said at least one group of lighting devices; detect changes in the total drive power fed to the group of lighting devices within the delay interval and counting the total number of changes; compare the total number of changes with a nominal number corresponding with the number of lighting devices within the group of lighting devices; and generate a lighting device error signal if the number of changes is smaller than the nominal number multiplied by a predetermined constant c, wherein $0<c\leq 1$. This lighting system is arranged to perform the above-described method.

Embodiments of the lighting system are provided, which present advantages corresponding to those provided by the above-described embodiments of the method.

According to an embodiment of the present invention, there is provided a method of controlling a lighting system comprising:

sending a change operational state command to a lighting device group comprising several lighting devices, and thereby prompting the lighting devices to change their operational state with individual predetermined delays within a delay interval;

detecting changes in the total drive power fed to the group of lighting devices within the delay interval and counting the total number of changes;

comparing the total number of changes with a nominal number corresponding with the number of lighting devices within the group of lighting devices;

generating a lighting device error signal if the number of changes is smaller than the nominal number multiplied by a predetermined constant c, wherein $0<c\leq 1$.

Consequently, by means of the present embodiment, it is possible to detect the presence of defective lighting devices in conjunction with a change of the operational state, such as turning the lighting devices on or off or dimming them. In spite of a simple communication structure, where the command is simply sent to all lighting devices in the group without having to generate any response or perform any procedure of identifying individual lighting devices, the method is able to detect defective lighting devices. Since the number of lighting devices of a group is limited, the burden for an operator to check which lighting device(s) in the group is defective is small in comparison with the gain of automatically detecting that a lighting device has become defective.

The use of individual predetermined delays, as in the present embodiment, and a randomized delay, as in previously described embodiments, respectively, provide alternative solutions to the same technical problem, i.e. the problem of detecting that a lighting device is defective. Hence, these two solutions form a common inventive concept.

The present embodiment, which relates to the use of individual predetermined delays, may optionally be combined with features from the previously described embodiments.

For example, the detecting changes in the total drive power may comprise obtaining knowledge about a single change, which corresponds to the amount of change caused by a single lighting device, and determining, in conjunction with the sending of a first change operational state command, the nominal number by means of at least one of the total number of changes and the total amount of change caused by the total number of changes.

In the present example, the obtaining knowledge about a single change may for example comprise determining a median amount of change of all changes, and setting that median amount as the single change.

Additionally or alternatively, the detecting changes in the total drive power may for example comprise determining the number of lighting devices that each detected change corresponds to by comparing the amount of the change with the single change. In case two or more of the individual predetermined delays have the same or similar durations, the change in operational state of the corresponding lighting devices may cause changes in the total drive power which are undistinguishable from each other in time. That will be detected by comparing the amount of the change in the total drive power with the single change, and thereby erroneous indications about defective lighting devices are prevented.

According to an embodiment, the duration of the individual predetermined delay of each of the lighting devices is distinct from the duration of the individual predetermined delays of any other of the lighting devices. The present embodiment reduces the risk of two or more lighting devices changing operational state simultaneously and facilitates detection of individual operational state changes via changes in the total drive power fed to the group of lighting devices.

According to an embodiment, the lighting devices are preconfigured with the respective individual predetermined delays.

According to an embodiment, the method further comprises: at each of the lighting devices, applying the respective individual predetermined delay within the delay interval; and changing the operational state in accordance with the change operational state command at each of the lighting devices at the end of each respective delay.

According to an embodiment, the detecting changes in the total drive power comprises determining the nominal number as an average of respective total numbers of changes associated with change operational state commands previously sent to the lighting device group. In the present embodiment, the nominal number is updated during operation of the lighting system and may be automatically adapted to changing conditions rather than being fixed to a number of lighting devices present in the group of lighting devices at some earlier stage, potentially several months/years back in time. For example, the average may be formed based on numbers from with the last month.

According to an embodiment of the present invention, there is provided a lighting device comprising at least one light source, and a drive unit connected with the at least one light source, wherein the drive unit is arranged to apply an individual predetermined delay within a predetermined delay interval, upon the receipt of a change operational state command, and to change the operational state of the lighting device at the end of the applied delay. Since the drive unit is capable of delaying the change of operational state by an individual predetermined delay, it is possible to detect that change over one and the same power line for several lighting devices, although they are not actively sending any information to a controlling device. The drive unit may optionally comprise a light source controller, a delay unit connected with the light source controller, and a drive voltage generator connected with the light source controller.

According to an embodiment of the present invention, the lighting system described above comprises at least one lighting device group, each lighting device group comprising several lighting devices having drive units arranged to apply individual predetermined delays within the delay interval (instead of applying a randomized delay), upon the receipt of the change operational state command.

According to an embodiment of the lighting system, the duration of the individual predetermined delay of each of the lighting devices is distinct from the duration of the individual predetermined delays of any other of the lighting devices.

According to an embodiment of the method, or of the lighting system, c=1.

Embodiments of the lighting system are provided, which present advantages corresponding to those provided by the above-described embodiments of the method.

BRIEF DESCRIPTION OF THE DRAWINGS

The invention will now be described in more detail and with reference to the appended drawings in which.

DESCRIPTION OF PREFERRED EMBODIMENTS

Figure 1:
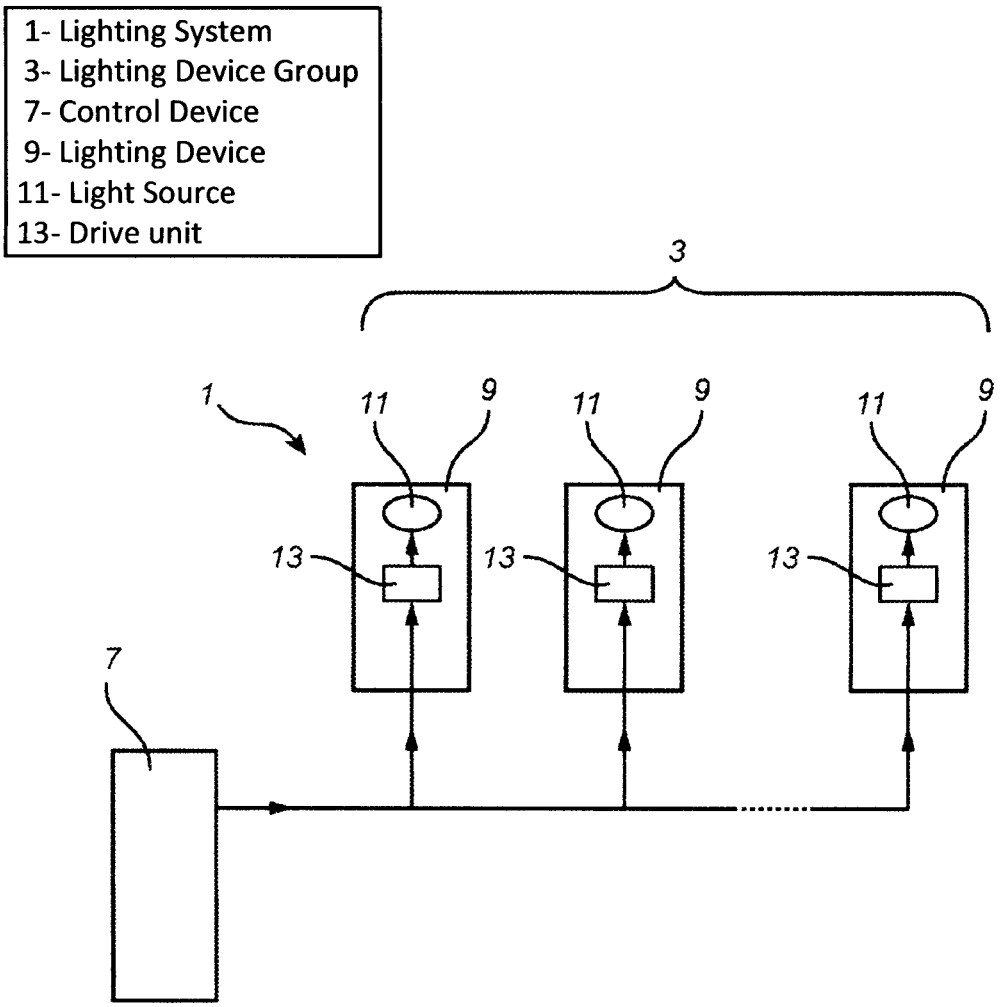
FIG. 1 is a block diagram of an embodiment of a lighting system according to the present invention.

Below embodiments of the method and lighting system according to the invention will be described. Reference numerals appearing in different figures indicate corresponding elements in all figures.

According to a first embodiment of a lighting system 1 it comprises one lighting device group 3, and a control device 7, which is connected with the lighting device group 3. The lighting device group 3 comprises several lighting devices 9. The communication in the lighting system 1 is unidirectional from the control device 7 to the lighting devices 9. Each lighting device 9 comprises at least one light source 11, and a drive unit 13 connected with said at least one light source 11 for feeding a drive voltage to the at least one light source 11.

For instance, the lighting system 1 is used for street lighting, and the lighting devices 9 are dimmable, and can thus be set on, off or at an intermediate level. However, many other applications of the lighting system are feasible, such as horticulture/agriculture, industrial lighting, and area lighting, e.g. parking lighting.

The lighting system 1 is arranged to operate as follows, thereby performing an embodiment of the method of controlling a lighting system. The control device 7 is arranged to monitor the power consumption at least during particular periods during which the operational state of the lighting devices 9 is changed. When it is time to change the operational state of the lighting devices 9, the control device 7 sends a control command called change operational state command to the lighting devices 9, see box 21 in FIG. 3. The change operational state command is transmitted as a superimposed data signal on the power line. Such signaling on a power line can be made by means of any known technique as the person skilled in the art is well acquainted with.

Typically, it is time to change the operational state when the sun rises, when the sun sets, and when it becomes dark enough for some other reason, such as bad weather conditions. The operational state can also be changed due to other circumstances than a change of ambient light. For instance, it can be dependent on traffic intensity, etc., where the light source is typically dimmed up and down in dependence on the intensity. Several further arrangements can be made as regards the change of operational state, as already employed in known lighting control systems. Preferably, the checking of defect lighting devices 9 is made when they are being turned off, since that is a faster change than for instance turning them on.

The drive unit 13 of each lighting device 9 is arranged to receive the change operational state command. At reception of the change operational state command, the drive unit 13 applies a random delay, box 22. According to this embodiment the length of the delay is randomly determined at a first time, such as a first power up or a first reception of a first change operational state command, and then the same delay is applied every time.

When the delay has come to an end the drive unit 13 adjusts its voltage output level accordingly, box 23. It should be noted that over time, such as twenty-four hours, typically, several different change operational state commands, which command the lighting device to change state in different ways, are sent. The delay can be used at one particular change, such as turning off lights at sunrise, or at all changes, etc. Thus, alternatively, at receipt of the change operational state command, the drive unit 13 additionally determines whether this particular command is one where a delay should be introduced or not. According to this first embodiment, if an operational state change with random delay is going to be performed, the change operational state command includes information about the length of a delay interval, within which the randomized delay is to be chosen. Thus, when the drive unit detects that the change operational state command includes information about the delay interval, it will determine the randomized delay.

However, alternatively, the delay can be randomly determined every time, and will thus be different from one time to another. Still another option is to program the drive unit 13 with the delay in advance, such as at manufacture of the lighting device 9 or at mounting of the lighting device 9 in the lighting system 1, and then the predetermined delay is applied by the drive unit 13. It is, however, preferred to provide a drive unit 13, which is capable of adapting its delay to a delay interval that is received with the command. In any case above, for the purposes of this application, the expression "apply a random delay" is considered to include all alternatives mentioned above.

Thus, the randomized delay is chosen within predetermined limits defining a delay interval. The width of the delay interval should be chosen wide enough to house a number of possible random delays that is several times higher than the number of lighting devices in the group. Furthermore, the distance between two neighboring delays has to be long enough for the control device 7 to be able to discriminate between them in order to detect them as two different changes of operational state.

As an example, the delay interval is 60 seconds for a lighting system 1 in which the lighting device group 3 contains a relatively large number of lighting devices 9, such as for instance 200 lighting devices 9. For a relatively small number of lighting devices 9, such as 20 lighting devices 9, the delay interval is 6 seconds. The resolution, i.e. the time between two consecutive determinations of the power consumption, is chosen to be about 10 ms. This means that for instance in a 50 Hz AC power lighting system 1 with the 60 s delay interval, the power consumption is determined during 70 s in order to cater to latency of the commands, resulting in 7000 determinations of the power consumption. For a lighting system 1 of 200 lighting devices 9, which randomly determines their delay length the likelihood of two lighting devices 9 changing operational state at the same time, i.e. within the resolution, is comfortably small. If it would occur, the control device 7 is well prepared to detect and handle such a situation.

The delay interval carried by the change operational state command works as a delay trigger that tells the drive units 13 that the change is to be executed after the delay, instead of instantly. As explained above one or more other change operational state commands can be sent by the control device 7 without causing a delayed change. They will be sent without any information about delay interval, and thereby the drive units 13 will not apply the delay but execute the change at once. Other delay triggers, such as a simple flag etc., are of course feasible as understood by the person skilled in the art.

During a time period corresponding to the delay interval the control device 7 detects changes in the total drive power, which is fed to the group 3 of lighting devices 9, and counts them. Thereby the control device 7 obtains a total number of changes Ctot, box 24.

Referring to box 25, the total number of changes Ctot is compared with a nominal number of changes Cnom, which corresponds with, i.e. equals to, the number of lighting devices 9 within the lighting device group 3. If Ctot<Cnom, i.e. the detected number of changes is less than the number of lighting devices 9, then the control device 7 decides that at least one lighting device 9 is defective, and the control device 7 generates a lighting device error signal, box 26. This lighting device error signal can be of any suitable kind, and be presented in any suitable way, as understood by the person skilled in the art.

In order to increase the correctness and accuracy of the detection, the control device 7 obtains knowledge about a single change, i.e. the amount of change of power consumption that a single lighting device 9 causes when it changes its operational state. This knowledge can be obtained in different ways. For example, a power value of the single change can be known in advance by an operator, who inputs the value when mounting the lighting system 1, or it can be programmed in the control device 7 at some later point of time. However, according to this embodiment a median amount of change among all changes detected during the delay interval is determined and used as a value of the single change. Using a median value excludes erroneous detections of extreme values from affecting the size of the single change.

The nominal number Cnom is determined as the total number of changes detected during the delay interval in conjunction with a first sending of a change operational state command which includes the length of the delay interval. In order to ensure that only true changes are detected only changes of a size approximately as large as the single change are considered to be caused by a lighting device 9. Typically a deviation interval around the median value is determined. In order to allow more than one lighting device to change operational state simultaneously also values corresponding with multiples of the single change are counted, where the multiple equals the number of lighting devices 9.

Figure 4:
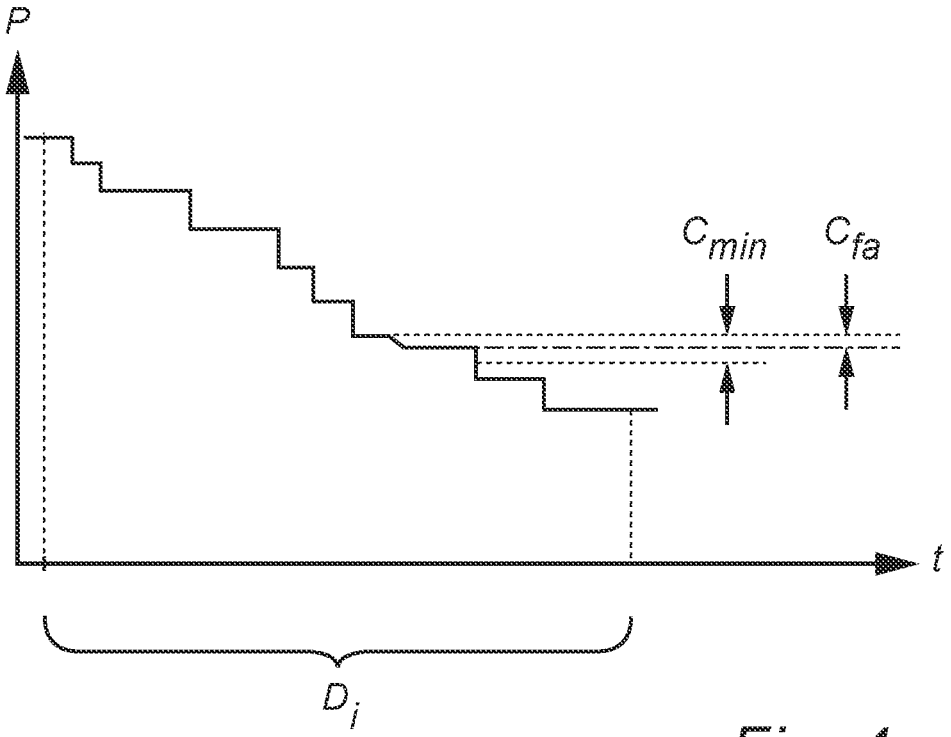
FIG. 4 is a time diagram illustrating the change of power consumption during a change of operational state of a group of lighting devices.

FIG. 4 illustrates an example of a group of lighting devices 9 being randomly turned off, by means of a graph showing total power consumption versus time. All lighting devices, eight in total, are turned off during the delay interval Di, but at different points in time randomly and individually determined by the different lighting devices 9 of the group 3. One change Cfa is disregarded as false since the size of the change Cfa is smaller than a lower limit Cmin of an accepted change.

It should be noted that it would be possible to continuously monitor the power consumption and to detect a sudden decrease thereof at any time, and consider that decrease to be caused by a failure of a single lighting device. However, the power consumption may vary slightly due to other causes, and if the lighting device group comprises many lighting devices the effect of a single failure on the total power consumption is small. Therefore, such a method would be a lot more uncertain than the present method where the monitoring is limited to a particular time period and the amount of a single change is at least approximately known.

According to a second embodiment of a lighting system 1 it comprises several lighting device groups 3, 5, each comprising several lighting devices 9, and a control device 7, which is connected with the groups 3, 5 for controlling them individually or in common. According to one alternative of controlling several groups, they are all connected to the same power line, i.e. main power. In other words, the control device 7 has a single power line for detecting changes of operational states in all groups 3, 5. In order to be able to know which group causes the change, the change of operational state commands that include the delay trigger are individually coded. When the lighting device 9 of a particular lighting device group 3, 5 receives the command it checks the code, and it will only perform the change of operational state, including the delay, if the code is correct. By separating the individually coded commands in time, such that there is a time slot between the delay intervals, the control device 7 knows which lighting device group 3, 5 causes the power changes.

Furthermore, as an alternative to the first embodiment, where the drive unit was arranged to perform all functions, typically by being programmed accordingly, in this second embodiment an alternative is described where the functions are realized by hard ware components, or at least the software is represented as separate units. Consequently, each lighting device 9 comprises at least one light source 11, a drive unit 13 connected with said at least one light source for generating a drive voltage with a drive voltage generator 19, a light source controller 15, connected with the control device 7 for receiving control commands, and connected with the drive unit 13 for controlling its output. Furthermore, the lighting device 9 comprises a delay unit 17, which is connected with the light source controller 15, or integrated therein. It should be noted, though, that many features described herein are independent of the internal structure of the lighting devices 9, as will be understood by the person skilled in the art.

The light source controller 15 of each lighting device 9 receives the change operational state command. The light source controller 15 triggers the delay unit 17 to determine a random delay. When the delay has come to an end the delay unit 17 signals this to the light source controller 15, which then adjusts the voltage output level of the drive unit 13 accordingly. The control device 7 acts in the same way as in the first embodiment for providing the lighting device groups 3, 5 with change operational state commands, and detecting defective lighting devices 9.

Figure 2:
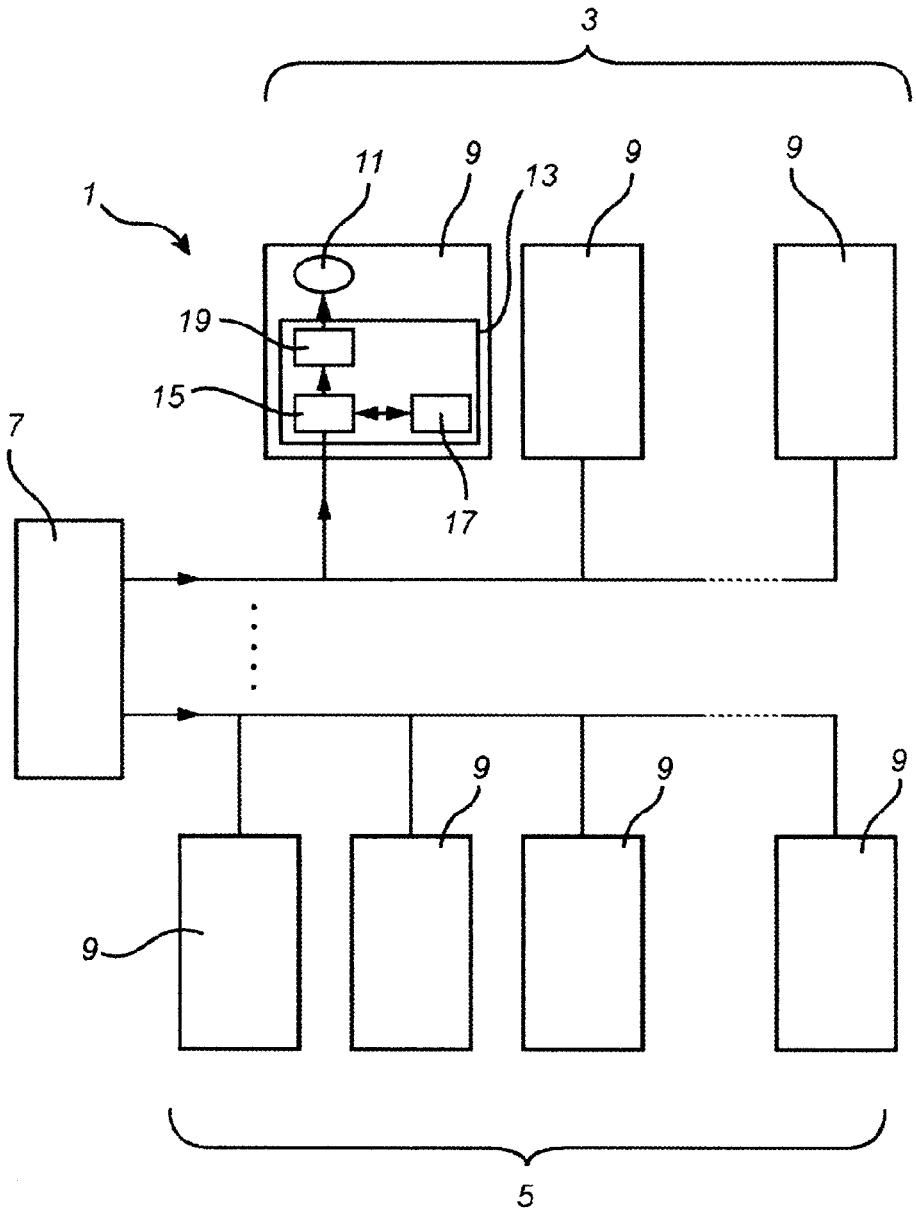
FIG. 2 is a block diagram of another embodiment of a lighting system according to the present invention.

An example application of the lighting system depicted in FIG. 2 is a lighting system 100 comprising a first lighting device group 3 of traffic attention points 9, i.e. lighting devices 9 among which even a single malfunction should be addressed as quickly as possible, and a second lighting device group 5 of ambient light points 9, i.e. lighting devices 9 for which proper operation of the individual lighting devices 9 is not as important. The control device 7 is arranged to generate a lighting device error signal if the number of changes in the drive power associated with one of the groups 3, 5 is smaller than a respective nominal number, or a percentage thereof, i.e. the nominal number multiplied by a respective predetermined constant c, wherein $0<c\leq 1$. The nominal numbers in the present embodiment are the number of lighting devices 9 in the respective groups 3, 5. Since proper operation of the traffic attention points 9 in the first group 3 is so important, a value $c=1$ may be used such that an error signal is generated as soon as a single traffic attention point 9 malfunctions. Since proper operation of the ambient light points 9 in the second group 5 is not as important, a value $c<1$ may be used, allowing a certain percentage of the ambient light points 9 to malfunction before an error signal is generated.

It is to be noted that the use of a constant c, wherein $0<c\leq 1$, to restrict generation of lighting device error signals until a certain percentage of the lighting devices are defective, may be employed analogously in other embodiments, such as the embodiments described with reference to FIG. 1.

Figure 5:
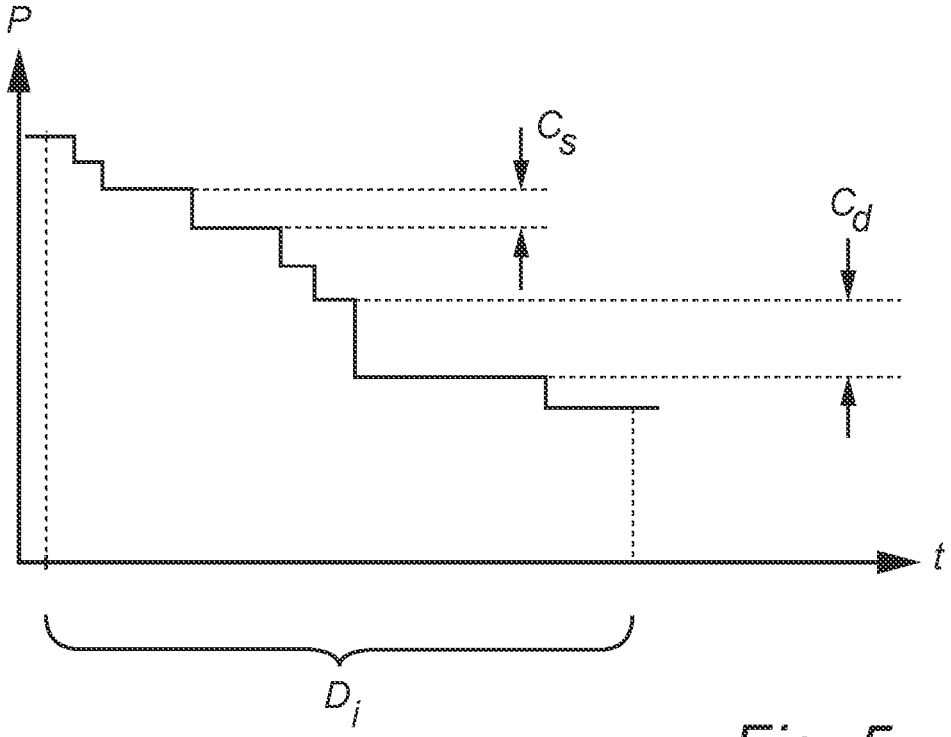
FIG. 5 is another time diagram illustrating the change of power consumption during a change of operational state of a group of lighting devices.

FIG. 5 illustrates an example of a group of lighting devices 9 being randomly turned off, by means of a graph showing total power consumption versus time. All lighting devices, eight in total, are turned off during the delay interval Di, but at points in time randomly and individually determined by the different lighting devices 9 of the group 3. In the present example, two lighting devices 9 happen to be turned off simultaneously, or at points in time which are close enough to be indistinguishable from each other by the control device 7 monitoring the total power consumption. This results in a change Cd in the total power consumption which is twice the size of a single change Cs. The control device 7 detects the change Cd and determines the number of lighting devices 9 that the detected change Cd corresponds to, i.e. two, by comparing the amount of the change Cd with the single change Cs. The control device 7 takes this number into account when counting the total number of changes, i.e. it counts the change Cd as two changes.

Figure 3:
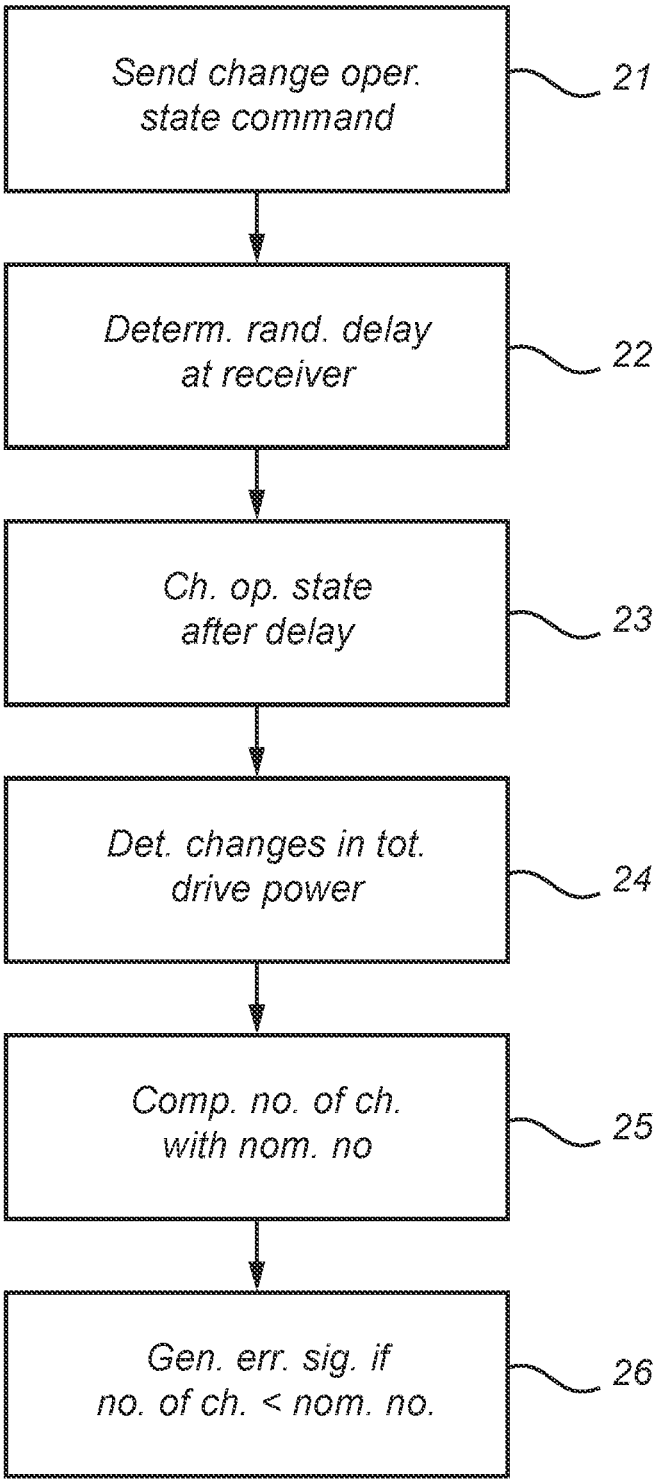
FIG. 3 is a flow chart illustrating an embodiment of the method according to the present invention.

In the embodiments described with reference to FIGS. 1 and 3, the drive units 13 of the lighting devices 9 are arranged to apply random delays. An alternative embodiment of a method of controlling a lighting system 1 will now be described with reference to FIG. 6, in which the drive units 13 are instead arranged to apply individual predetermined delays. Similarly to the method described with reference to FIG. 3, the method according to the present embodiment comprises the control device 7 sending a change operational state command to the lighting devices 9 (box 61). However, at reception of the change operational state command, the drive units 13 of the lighting devices 9 apply individual predetermined delays (box 62). The lighting devices 9, or their respective drive units 13, are preconfigured, e.g. programmed in advance, with the individual predetermined delays, e.g. during manufacture or during setup/configuration of the lighting system 1, and may apply their respective delays independently of each other and without any instructions from the control device 7 instructing individual lighting devices 9 which delays to apply.

In the present embodiment, the duration of the individual predetermined delay of each of the lighting devices 9 is distinct from the duration of the individual predetermined delays of any other of the lighting devices, i.e. the individual predetermined delays all have different durations, to reduce the risk of two or more lighting devices changing operational state simultaneously and to facilitate detection of individual operational state changes via changes in the total drive power fed to the group of lighting devices. The durations of the individual predetermined delays should preferably differ from each other to such an extent that changes in operational state of individual lighting devices are distinguishable from each other in time. For example, the durations may differ by e.g. at least 30 ms, or at least 20 ms, if the time resolution of the control device monitoring the total power consumption is 10 ms.

It is to be noted that embodiments are also envisaged in which some of the individual predetermined delays coincide. For example, the addition of new lighting devices to a lighting system 1, in which the individual predetermined delays of the lighting devices 9 already in use are unknown, may result in one or more coinciding delays. However, as described with reference to FIG. 5, one or more coinciding delays may be detected and handled by the control device 7.

Figure 6:
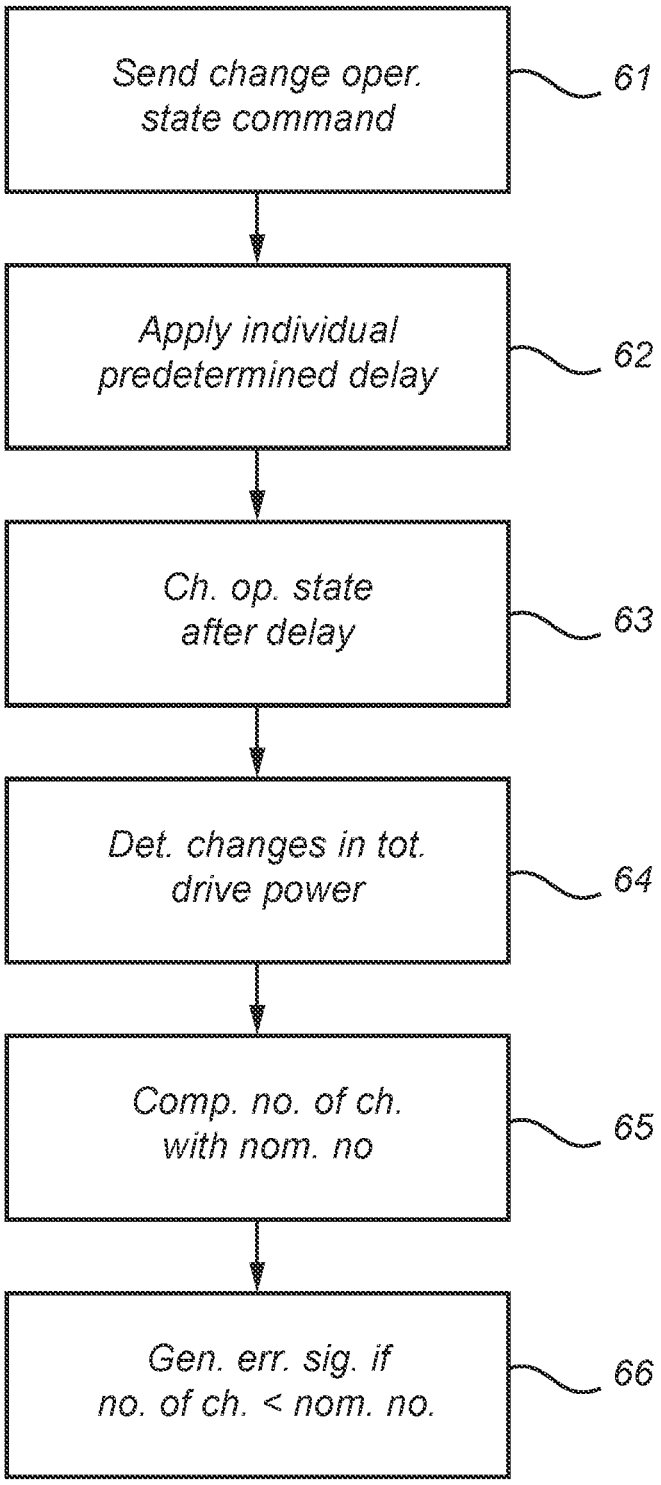
FIG. 6 is a flow chart illustrating an alternative embodiment of the method according to the present invention.

In the present embodiment, i.e. the method described with reference to FIG. 6, there is no need for the control device 7 to send information about a delay interval since the drive units 13 apply predetermined delays. However, a delay interval during which the control unit 7 detects changes in the total drive power should be long enough to cover all the individual predetermined delays. In case only some change operational state commands are to cause the drive units 13 to delay their change of operational state, such operational state commands may include or be accompanied by a trigger to inform the drive units 13 to apply their respective delays.

Similarly to the method described with reference to FIG. 3, the method according to the present embodiment continues by execution of changes in the operational states of the lighting devices 9 after their respective delays (box 63); detection of changes in the total drive power fed to the lighting devices 9 during a delay interval (box 64); comparison of the total number of changes with a nominal number (box 65); and generation of a lighting device error signal if the number of changes is smaller than the nominal number (box 66).

Embodiments are also envisaged in which some of the lighting devices 9, or the drive units 13, are configured to apply randomized delays, while some of the lighting devices are configured to apply individual predetermined delays.

It is to be noted that the method described with reference to FIG. 6 may be combined with the use of individual codes associated with different groups of lighting devices, described with reference to FIG. 2.

Above embodiments of the method of controlling a lighting system, the lighting device, and the lighting system according to the present invention as defined in the appended claims have been described. These should only be seen as merely non-limiting examples. As understood by the person skilled in the art, many modifications and alternative embodiments are possible within the scope of the invention as defined by the appended claims.

It is to be noted that for the purposes of his application, and in particular with regard to the appended claims, the word "comprising" does not exclude other elements or steps, and the word "a" or "an" does not exclude a plurality, which per se will be evident to a person skilled in the art.

The invention claimed is:

1. A method of controlling a lighting system comprising:

sending a change operational state command to a lighting device group comprising several lighting devices, and thereby causing the lighting devices to change their operational state with a randomized delay within a first delay interval or with individual predetermined delays within a second delay interval;

detecting changes in the total drive power fed to the group of lighting devices within the first or second delay interval and counting the total number of changes;

comparing the total number of changes with a nominal number corresponding with the number of lighting devices within the group of lighting devices; and generating a lighting device error signal if the number of changes is smaller than the nominal number multiplied by a predetermined constant c, wherein $0<c\leq 1$.

2. The method of controlling a lighting system according to claim 1, said detecting changes in the total drive power comprising obtaining knowledge about a single change of the detected changes, which corresponds to the amount of change caused by a single lighting device of the lighting devices, and determining, in conjunction with the sending of the change operational state command, the nominal number by means of at least one of the total number of changes and the total amount of change caused by the total number of changes.

3. The method according to claim 2, said obtaining knowledge about the single change comprising determining a median amount of change of all changes, and setting the median amount as the single change.

4. The method according to claim 2, said detecting changes in the total drive power comprising determining the number of lighting devices that each detected change corresponds to by comparing the amount of the detected change with the single change.

5. The method according to claim 1, wherein the lighting devices, in response to the change operational state command, change their operational state with said randomized delay, and wherein the change operational state command comprises a value of the first delay interval.

6. The method according to claim 1, wherein the lighting devices, in response to the change operational state command, change their operational state with said randomized delay, the method comprising:

at each lighting device, applying the randomized delay within the first delay interval; and changing the operational state in accordance with the change operational state command at each lighting device at the end of each respective delay.

7. The method according to claim 6, said applying the randomized delay comprising randomly determining a new delay every time a change operational state command including a delay trigger is received.

8. The method according to claim 6, said applying the randomized delay comprising determining a fixed random delay at a first power up of the lighting device.

9. The method according to claim 1, wherein the lighting devices in response to the change operational state command, change their operational state with said individual predetermined delays, the duration of the individual predetermined delay of each of the lighting devices being distinct from the duration of the individual predetermined delays of any other of the lighting devices.

10. The method according to claim 1, said detecting changes in the total drive power comprising determining the nominal number as an average of respective total numbers of changes associated with change operational state commands previously sent to the lighting device group.

11. The method according to claim 1, wherein c=1.

12. A lighting system comprising at least one lighting device group, each lighting device group comprising several lighting devices, and a control device connected with said at least one lighting device group, wherein each of the several lighting devices comprises at least one light source, and a drive unit connected with said at least one light source, wherein the drive unit is arranged to apply a randomized delay within a predetermined first delay interval or an individual predetermined delay within a second delay interval, upon receipt of a change operational state command, and to change the operational state of the lighting device at the end of the applied delay; and wherein the control device is arranged to send the change operational state command to said at least lighting device group; detect changes in the total drive power fed to the at least one lighting device group within the first or second delay interval and count the total number of changes; compare the total number of changes with a nominal number corresponding with the number of lighting devices within the at least one lighting device group; and generate a lighting device error signal if the number of changes is smaller than the nominal number multiplied by a predetermined constant c, wherein $0<c\leq 1$.

13. The lighting system according to claim 12, wherein the drive units of the lighting devices are arranged to apply individual predetermined delays within the second delay interval, upon the receipt of the change operational state command, the duration of the individual predetermined delay of each of the lighting devices being distinct from the duration of the individual predetermined delays of any other of the lighting devices.

14. The lighting system according to claim 12, wherein the drive unit comprises a light source controller, a delay unit connected with the light source controller, and a drive voltage generator connected with the light source controller.

* * * * *